United States Patent [19]

Marer

[11] 4,143,598

[45] Mar. 13, 1979

[54] NON-MAGNETIC ANTI-PERSONNEL WAR MINE

[75] Inventor: Joseph G. Marer, Berne, Switzerland

[73] Assignee: Redon Trust, Lichtenstein, Liechtenstein

[21] Appl. No.: 785,479

[22] Filed: Apr. 7, 1977

[30] Foreign Application Priority Data

Apr. 23, 1976 [CH] Switzerland ..... 005024/76
Jan. 28, 1977 [CH] Switzerland ..... 001155/77

[51] Int. Cl.[2] ..... F42B 23/28
[52] U.S. Cl. ..... 102/8
[58] Field of Search ..... 102/8

[56] References Cited

U.S. PATENT DOCUMENTS 3,933,095 1/1976 Engeli ..... 102/8

FOREIGN PATENT DOCUMENTS 1428790 1/1969 Fed. Rep. of Germany ..... 102/8
2112174 7/1971 Fed. Rep. of Germany ..... 102/8

*Primary Examiner*—Charles T. Jordan
*Attorney, Agent, or Firm*—William Anthony Drucker

[57] ABSTRACT

A non-magnetic anti-personnel war mine, comprising a plastic body, a cap of elastic material, a retaining ring, a pan containing an explosive charge and a detonator, a firing pin plunger, a bag-shaped membrane and a firing pin plunger safety and release device. The firing pin plunger is guided in a guide socket and the bag-shaped membrane is held in the plastic body by two discs, the first disc having a maze communicating, by a centrally drilled hole, with the bag-shaped membrane. The firing pin plunger safety and release device is formed by a lever with two arms, where one arm rests against the bag-shaped membrane and the other is subjected to the force of a spring.

9 Claims, 9 Drawing Figures

NON-MAGNETIC ANTI-PERSONNEL WAR MINE

The present invention relates to a non-magnetic anti-personnel war mine, capable of being sown manually or mechanically, by ground or aerial means, for example; the said mine comprises a plastic body whose upper part is closed by a cap of elastic material to constitute a variable volume and pressure air chamber, and whose lower part is closed by a pan and constitutes a cylindrical housing containing the firing pin safety and release device, the detonator and the explosive charge, the said body having one central hole in which the firing pin plunger is fitted and a lateral hole in which a bag-shaped membrane is fitted.

A mine of this type is known to us, in which the firing pin plunger safety and release device comprises two symmetrical arms, pivoting at one of their extremities on a lid fitted above the explosive charge and hugging, with their other extremities, the bag-shaped membrane, these two arms being brought one towards the other by means of a spring attached to them; each arm is fitted with a latch which, when the arms are close one to the other, intercept the plunger whereas, when the bag is inflated and separates the arms one from the other against the said spring, the latches release the firing pin plunger. This device is complicated and, under the effect of violent shocks, the bag may inflate and provoke the bursting of the mine.

The purpose of the present invention is to remedy these disadvantages and to provide for a mine which is absolutely insensitive to shocks, to accidental falls, to explosive shock waves and will only explode under circumstances provoked by the passage on it of a man. The mine, subject of the invention, is characterised in that the firing pin plunger is guided within a guide socket, in that the bag-shaped membrane is retained in the mine body by a retaining ring which rests upon a first disc having an eccentrically drilled hole and, on its lower face, a maze communicating with a centrally drilled hole in a second disc which ensures the sealing between the first disc and the bag-shaped membrane, and in that the firing pin plunger safety and release device is formed by a lever with two arms, in balance with respect to its centre of rotation, where one arm rests against the bag-shaped membrane and the other is subjected to the force of a spring, the whole being so arranged that, when a pre-determined pressure is applied to the cap, this pressure provokes the compression of a spring acting upon the firing pin plunger and an increase in the air pressure within the air chamber so that the bag-shaped membrane inflates and provokes the rotation of the firing pin plunger safety and release device to allow the mine to explode.

The appended drawings show, by way of examples, two embodiments of the mine, subject of the invention.

Figure 1:
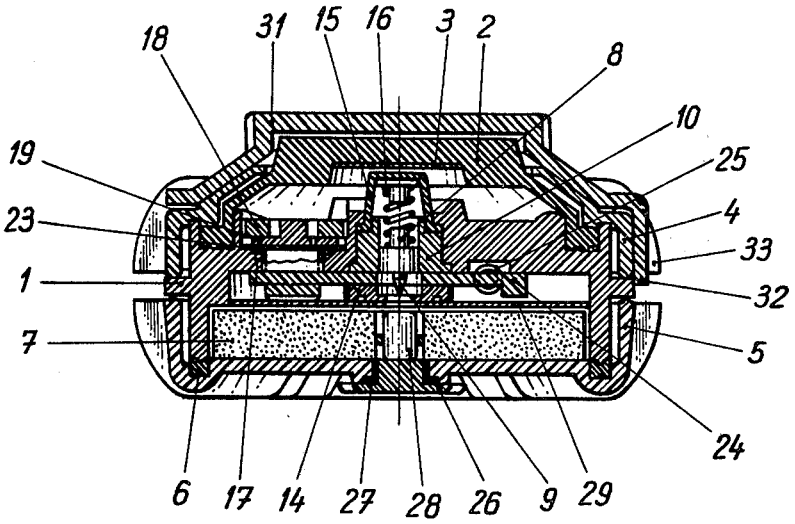
FIG. 1 shows a vertical section.
Figure 5:
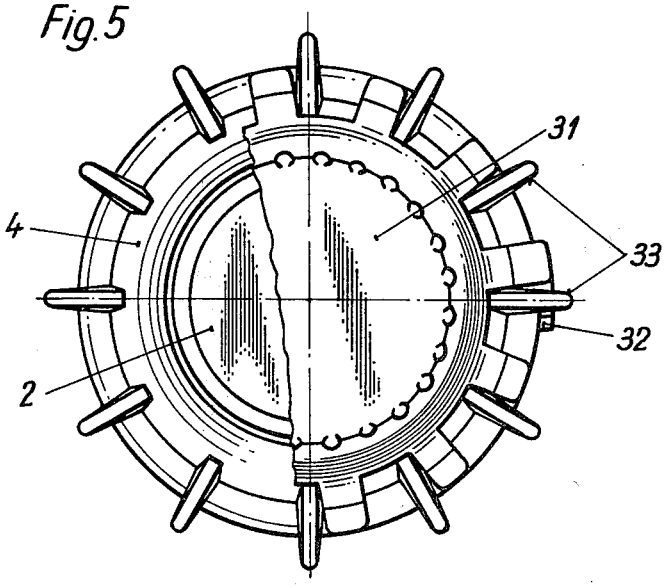
FIG. 5 shows a plan view of the mine, fitted with its safety cover.
Figure 2:
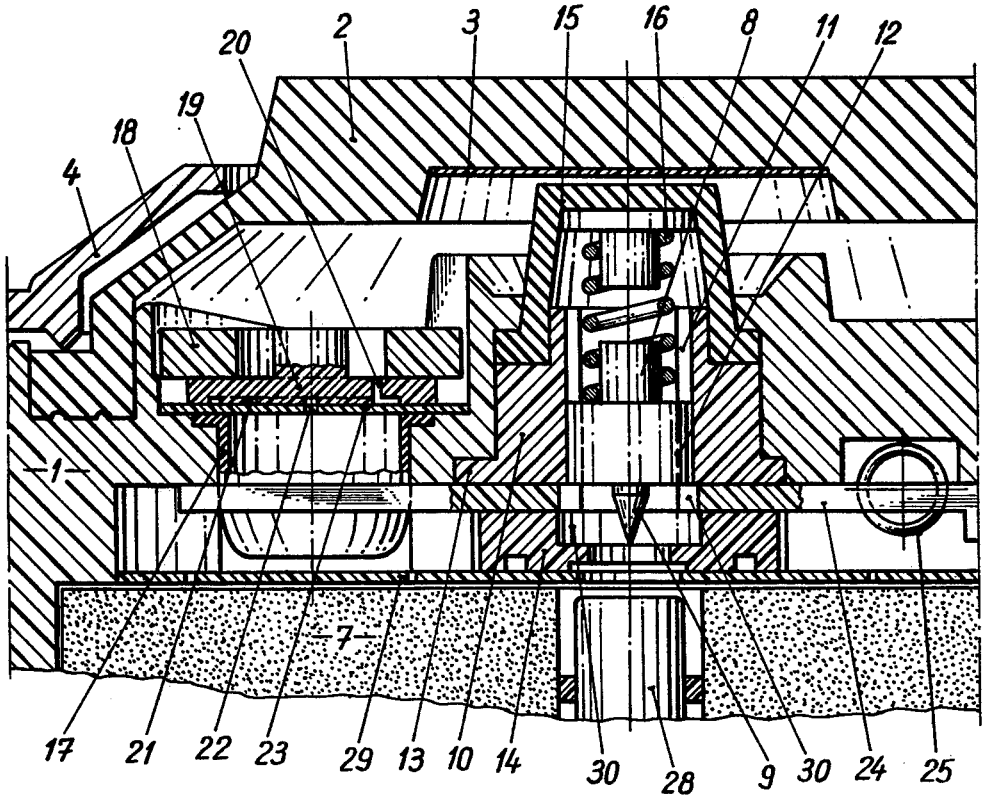
FIG. 2 shows a vertical section, at a larger scale, of the central part of the mine of the first embodiment.
Figure 3:
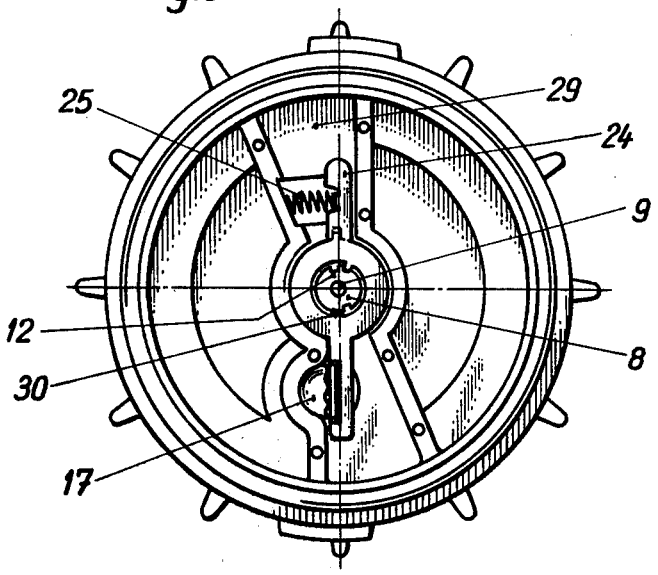
FIG. 3 shows the firing pin plunger safety and release device in the safety position.
Figure 4:
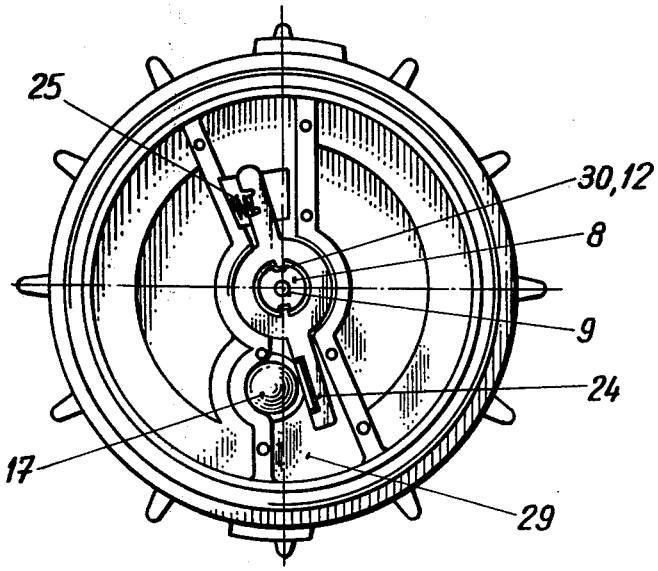
FIG. 4 shows a similar view as in FIG. 3, with the device in the operating position.

The mine as shown in FIGS. 1 to 5 and constituting the first embodiment comprises, on the one hand, an upper part including a plastic body 1 which constitutes, together with a cap 2 of elastic material which is fitted above the body and which holds a reinforcing plate 3, a variable volume and pressure air chamber, due to the fact that these two parts are hermetically sealed by a retaining ring 4 and, on the other hand, a lower part of plastic which forms, with the pan 5, a cylindrical housing made air-tight by a gasket 6 and containing the detonator 28 and the explosive charge 7.

The body 1 is drilled at its centre and in a lateral position.

The central hole is used to fit the plunger 8 with its firing pin 9. The said plunger is guided in the central hole by a guide socket 10 which has two diametrically opposed ribs 11 that will engage in two grooves 12 preventing any rotation of the plunger 8 but allowing its translation along the median axis of the mine. An appendage 13 on the guide socket 10 serves to position the latter with respect to the body 1. In addition, the guide socket 10 is held in place by a retaining ring 14 and by a membrane 15 which constitutes at the same time, the housing for a spring 16 acting on the plunger 8 and ensures the sealing between the upper and lower parts of the mine body 1.

The lateral hole contains a cylindrical membrane that is bag-shaped 17, that is held by a retaining ring 18 which also serves to hold a first disc 19 having a hole 20 drilled through it and machined, on its lower face, so as to form a maze 21 for the air entering the bag-shaped membrane 17 through the hole 22 in a second disc 23 resting against the edge of the said membrane and which ensures, in its turn, the sealing between the upper and lower parts of the mine body 1.

At the centre of the lower part of the body 1, extending from the central hole, is fitted the firing pin plunger safety and release device which comprises a lever with two arms 24 that are perfectly balanced and held in its safety position by a spiral spring 25.

The pan 5 has a central threaded hole into which is screwed a detonator holder 26 fitted with a sealing gasket 27 and the detonator 28. An intermediate component 29 separates the explosive charge 7 from the firing pin plunger safety an release device.

When the cap 2 is subjected to a pre-determined pressure, this will provoke a double action: the compression of the spring 16 and the increase of the pressure within the air chamber. The spring 16 applies its force on to the plunger 8 but the latter is unable to move due to the plunger safety and release device so long as the bag-shaped membrane 17 is not inflated. Due to the effect of the pressure in the air chamber and after the passage of air through the maze 21, the membrane 17 will inflate and its expansion forces the firing pin plunger safety and release device, against the force of the spring 25, to rotate with respect to the plunger 8 and to bring the ribs 30 with which it is fitted opposite the grooves 12 of the plunger. In this position, the plunger 8 is driven down by the spring 16 and its pin 9 strikes the detonator 28 and causes the charge 7 to explode.

In addition, the mine described includes a safety cover 31 which possesses two diametrically opposed appendages 32 that, when the said cover is rotated in a clockwise direction, engage under the anti-shock ribs 33 of the retaining ring 4. When the cover 31 is turned in an anti-clockwise direction, the appendages 32 disengage from the ribs 33 on the retaining ring 4 and the said cover is free. This latter facility is necessary when the mines are sown by means of automatic laying devices, since the mines must be on safe when inserted into the containers. When the mines are actually sown, the safety covers 31, previously turned anti-clockwise, will be separated from the mine.

Figure 6:
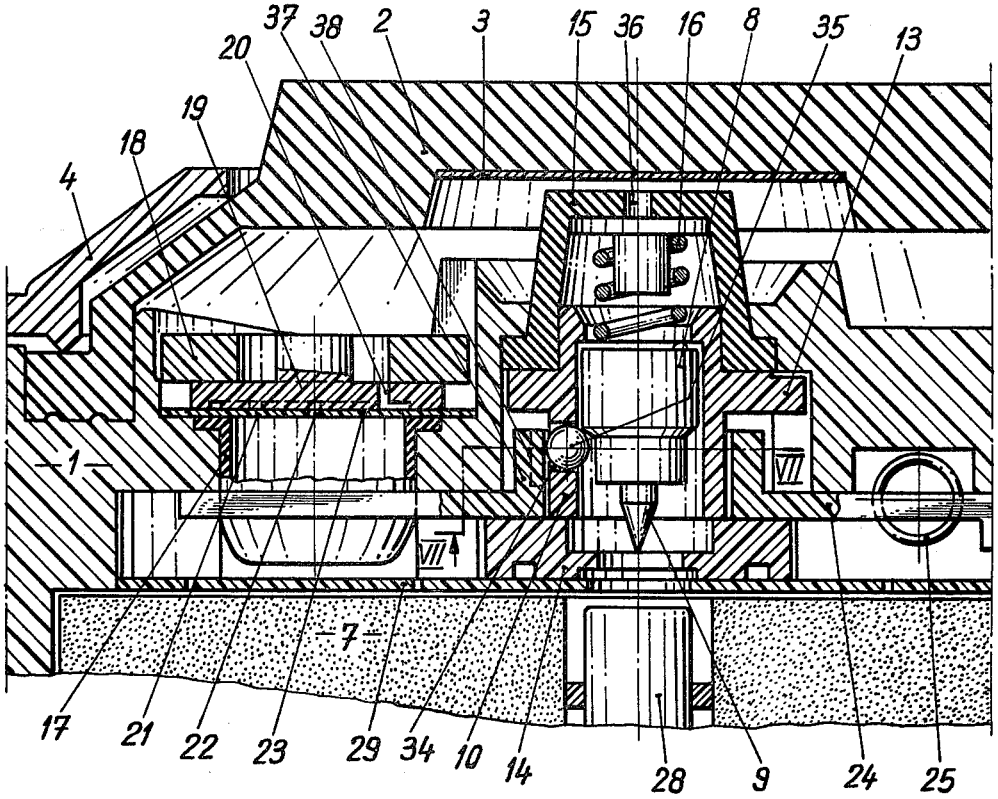
FIG. 6 shows a view of the firing pin plunger safety and release device in the safe position of the second embodiment.
Figure 7:
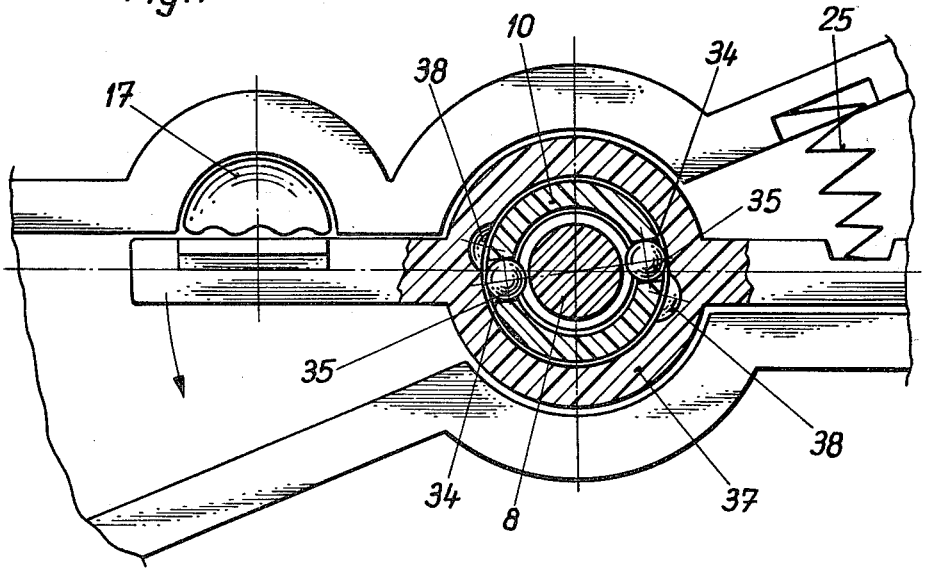
FIG. 7 shows a section along the line VII—VII in FIG. 6.
Figure 8:
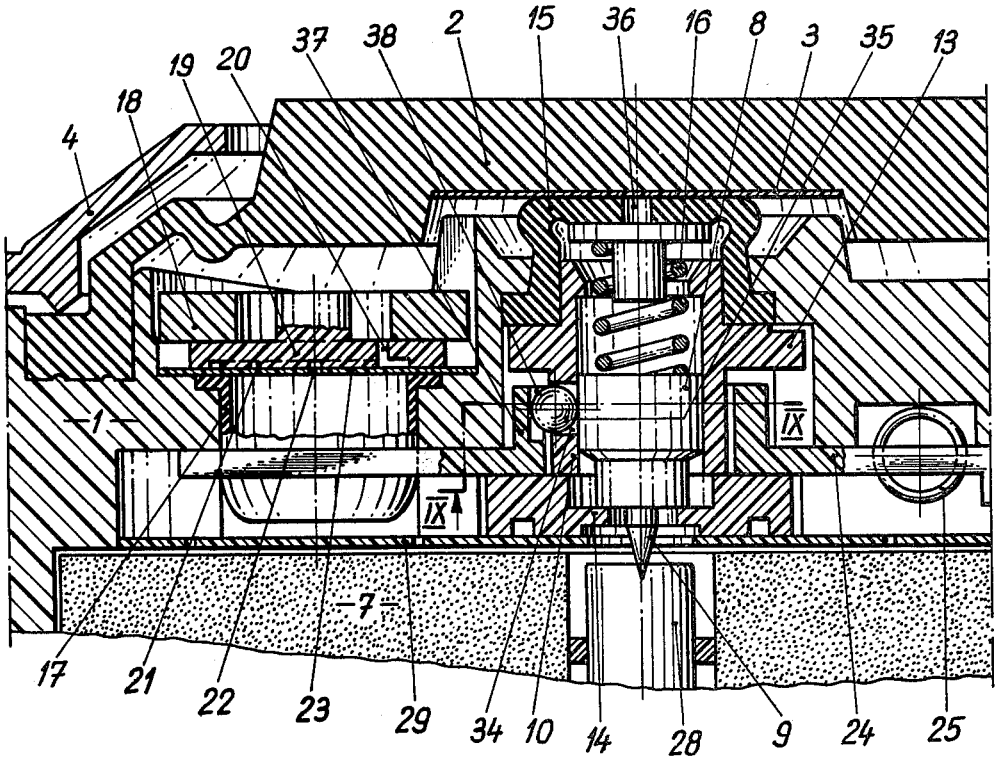
FIG. 8 shows a view similar to that shown in FIG. 6, but with the said device in its operating position.
Figure 9:
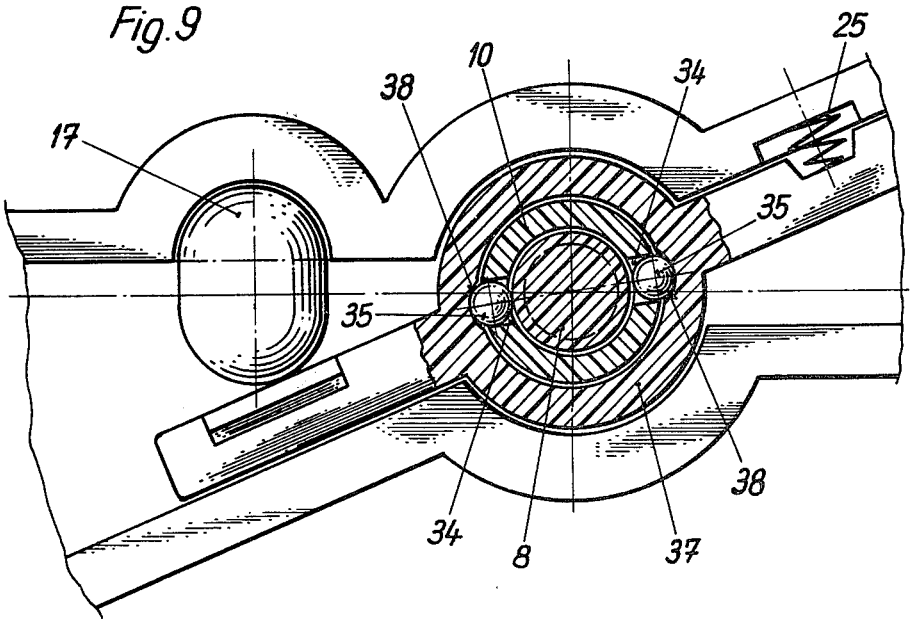
FIG. 9 shows a section along the line IX—IX in FIG. 8.

The mine as shown in FIGS. 6 to 9 comprises, as in the first embodiment, on the one hand, an upper part including a plastic body 1 which constitutes, together with a cap 2 of elastic material which is fitted above the body and which holds a reinforcing plate 3 at its centre, a variable volume and pressure air chamber, due to the fact that these two parts are hermetically sealed by a retaining ring 4 and, on the other hand, a lower part of plastic which forms, with a pan 5 (FIG. 1), a cylindrical housing made air-tight by a gasket 6 (FIG. 1) and containing the detonator 28 and the explosive charge 7.

The firing pin plunger 8 with its firing pin 9 is fitted in to the central hole of the body 1. The said plunger is guided within the central hole by a guide socket 10 in which two holes 34 are drilled in diametrically opposite places and in which are fitted two balls 35 that retain the plunger 8, but do not impede its translation along the median axis of the mine when it is released. An appendage 13 on the guide socket 10 positions the latter within the body 1. In addition, the guide socket 10 is held in place by a retaining ring 14 and by a membrane 15 which constitutes at the same time, the housing for a spring 16 acting on the plunger 8 and ensures the sealing between the upper and lower parts of the mine body 1. The said membrane 15 has a hole 36 drilled centrally in it which, when the mine is at rest, allows the passage of air between the upper and lower chambers. However, when the cap 2 is compressed (FIG. 8), the disc 3 closes off the central hole 36 and prevents the passage of air between the two chambers.

The lateral hole contains a cylindrical membrane that is bag-shaped 17, that is held by a retaining ring 18 which also serves to hold a first disc 19 having a hole 20 drilled through it and machined, on its lower face, so as to form a maze 21 for the air entering the bag-shaped membrane 17 through the hole 22 in a second disc 23 resting against the edge of the said membrane and which ensures, in its turn, the sealing between the upper and lower parts of the mine body 1.

At the centre of the lower part of the body 1, extending from the central hole, is fitted the firing pin plunger safety an release device which comprises a lever with two arms 24 that are perfectly balanced and held in its safety position by a spiral spring 25. The central part of the two-arm lever 24 is fitted with a tubular part 37 in which are cut two diametrically opposite slots 38. An intermediate component 29 separates the explosive charge 7 from the firing pin plunger safety and release device.

The remainder of the mine is made as described in the FIGS. 1 to 5.

When the cap 2 is subjected to a pre-determined pressure, this will provoke a double action: the compression of the spring 16 and the increase of the pressure within the air chamber. The spring 16 applies its force on to the plunger 8 but the latter is unable to move due to the plunger safety and release device so long as the bag-shaped membrane 17 is not inflated. Due to the effect of the pressure in the air chamber and after the passage of air through the maze 21, the membrane 17 will inflate and its expansion forces the firing pin plunger safety and release device, against the force of the spring 25, to rotate with respect to the guide socket 10 and to bring the slots 38 in the tubular part 37 of the two-arm lever 24 opposite the balls 35 that retain the plunger 8. In this position, the plunger 8 is driven down by the spring 16 and its pin 9 strikes the detonator 28 and causes the charge 7 to explode.

It follows from the explanations given above that the mine may only explode if a pre-determined pressure acts upon the cap 2 for a sufficient length of time for the bag-shaped membrane 17 to expand. In other words, the mine is insensitive to shocks, even of a violent character, to accidental falls, to explosive shock waves and is only sensitive to the action resulting form the passage on it of a man.

I claim:

1. In a non-magnetic anti-personnel war mine, capable of being sown manually and mechanically, having:

(i) a plastic body having an upper part and a lower part, and including a central hole and a lateral hole, the upper part being closed by a cap of elastic material to constitute a variable volume and pressure air chamber, the lower part being closed by a pan and constituting a cylindrical housing, (ii) a firing pin plunger safety and release device, a detonator, and an explosive charge, all contained in said cylindrical housing, (iii) a firing pin plunger in said central hole of the plastic body, (iv) a bag-shaped membrane in said lateral hole of the plastic body, the improvement that:

(a) said firing pin plunger is guided within a guide socket, (b) said bag-shaped membrane is retained in said plastic body by a retaining ring which rests upon a first disc having an eccentrically drilled hole and a maze on its lower surface, said maze communicating with a centrally drilled hole in a second disc which ensures the sealing between the first disc and the bag-shaped membrane, (c) said firing pin plunger safety and release device is formed by a lever with two arms, in balance with respect to its centre of rotation, one said arm resting against said bag-shaped membrane, the other said arm being subjected to the force of a spring, the whole being arranged so that, when a predetermined pressure is applied to said cap, said pressure causes the compression of a spring acting upon said firing pin plunger and an increase in the air pressure within the air chamber such that the bag-shaped membrane inflates and causes rotation of the firing pin plunger safety and release device to allow the mine to explode.

2. A non-magnetic anti-personnel war mine according to claim 1, characterized by the fact that the guide socket of the firing pin plunger is furnished with two diametrically opposite ribs that engage into two grooves machined in the plunger.

3. A non-magnetic anti-personnel war mine according to claim 2, characterised by the fact that the central part of the two-arm lever has two ribs which, in the safety position, are displaced with respect to the two grooves on the firing pin plunger.

4. A non-magnetic anti-personnel war mine according to claim 1, characterised by the fact that the guide socket of the firing pin plunger is drilled in two diametrically opposite places in which are fitted two balls which, in the mine's safety position, retain the plunger.

5. A non-magnetic anti-personnel war mine according to claim 4, characterised by the fact that the central part of the two-arm lever is fitted with a tubular part in which two diametrically opposite slots are cut and which, in the mine's safety position, are displaced with respect to the balls.

6. A non-magnetic anti-personnel war mine according to claim 1, characterised by the fact that an elastic membrane ensures the sealing between the air chamber and the lower part of the mine and serves as a housing for the spring acting upon the firing pin plunger.

7. A non-magnetic anti-personnel war mine according to claim 6, characterised by the fact that the bag-shaped membrane has a centrally positioned hole in it.

8. A non-magnetic anti-personnel war mine according to claim 1, characterised by the fact that the cap has a reinforcing disc inserted in its centre.

9. A non-magnetic anti-personnel war mine according to claim 1, characterised by the fact that it includes a safety cover fitted with two appendages that are located on opposite sides and designed to engage on a retaining ring that ensures the sealing between the body and the cap.

* * * * *